United States Patent [19]

Stobb

[11] Patent Number: 4,502,828

[45] Date of Patent: Mar. 5, 1985

[54] AUTOMATED SHEET-MOVING SYSTEM

[75] Inventor: Walter J. Stobb, Pittstown, N.J.

[73] Assignee: Stobb, Inc., Clinton, N.J.

[21] Appl. No.: 536,360

[22] Filed: Sep. 27, 1983

Related U.S. Application Data

[63] Continuation of Ser. No. 270,921, Jun. 5, 1981, abandoned.

[51] Int. Cl.[3] ..... B65H 1/26

[52] U.S. Cl. ..... 414/226; 271/157; 414/744 A

[58] Field of Search ..... 271/3.1, 157–159; 414/225, 226, 744 R, 744 A; 198/339, 346, 472, 648

[56] References Cited

U.S. PATENT DOCUMENTS

| | | | |
|---|---|---|---|
| 3,421,641 | 1/1969 | Frey | 414/744 R |
| 3,635,463 | 1/1972 | Stobb | 271/6 |
| 3,825,134 | 7/1974 | Stobb | 271/3.1 X |
| 3,853,234 | 12/1974 | Stobb | 214/300 |
| 3,982,749 | 9/1976 | Stobb | 271/4 |
| 3,987,887 | 10/1976 | Gentili | 414/744 R X |
| 4,311,430 | 1/1982 | Frederick | 271/151 X |
| 4,353,675 | 10/1982 | Risener | 414/744 A X |

*Primary Examiner*—Richard A. Schacher

*Attorney, Agent, or Firm*—Arthur J. Hansmann

[57] ABSTRACT

An automated sheet-moving system for moving sheets from a printing press and to a bindery and with a fully automated system where the sheets need not be manually handled. The sheets are initially formed in a stack on a stacker and are then placed onto a tray where a pick-up mechanism moves the sheets to a station adjacent a bindery feeder. An automated pick-up then moves the sheets from the station to the bindery feeder, in response to the requirement for sheets in the bindery feeder. A specially provided tray and pick-up mechanism are inter-related so that the pick-up mechanism can engage the tray and pick up the tray with the sheets thereon, and the mechanism can also eject the sheets from the tray at the location of the bindery feeder.

10 Claims, 7 Drawing Figures

AUTOMATED SHEET-MOVING SYSTEM

This is a continuation of U.S. patent application Ser. No. 270,921, filed June 5, 1981, and now abandoned.

This invention relates to an automated system for moving sheets between a printing press and a sheet bindery, and the invention includes both apparatus and method for accomplishing the movement of the sheets.

BACKGROUND OF THE INVENTION

The prior art already includes apparatus and method for positioning sheets in a stream of overlapped or shingled sheets which are moved to a collection point where the shingled sheets are formed into a stack of sheets. At that point, the sheets are sometimes manually lifted to another location, and the sheets are sometimes strapped into discrete stacks and end boards and metal strapping may be used for containing the sheets in the stack. In those prior art examples, manual handling is required and/or strapping and end boards are required, and thus the prior art requires labor and the materials mentioned, both of which are eliminated in the present invention.

The present invention provides for both apparatus and a method for fully automating the movement of sheets between a printing press and a sheet bindery, such that no manual handling is required and there is no requirement for special sheet stacking and tying materials. In accomplishing this objective, the present invention provides apparatus and method for receiving a stack of sheets on a tray or the like and lifting and moving the stack of sheets by an automated mechanism, such as a robot, to a position adjacent the sheet bindery of the conventional nature, and from there the sheets are again maneuvered by automatic equipment, such as a robot, and the tray with the stack of sheets thereon is lifted into the sheet bindery at which point the sheets are ejected from the tray and the tray is placed back into a magazine or the like and is available for re-use.

A further aspect of this invention is to provide a sheet quantity detecting mechanism in the sheet bindery, such as a sensor which will detect the height of the stack of sheets in the sheet bindery, and the sensor can be operatively related to the robot feeding the sheet bindery, so that the robot will operate to pick up a new stack of sheets on its tray and position that in the sheet bindery, all as required by the sensor effective with that sheet bindery.

Accordingly, the present invention provides apparatus and a method for automatically positioning a stack of sheets which is on a tray and to control the stack without requiring end boards and strapping of the stack in the conventional manner, but the present invention nevertheless does provide compression for the stack of sheets and physical control of the stack and its tray but without the requirement of tying and ultimately untying the stack of sheets.

DETAILED DESCRIPTION OF THE PREFERRED EMBODIMENT AND METHOD

Figure 1:
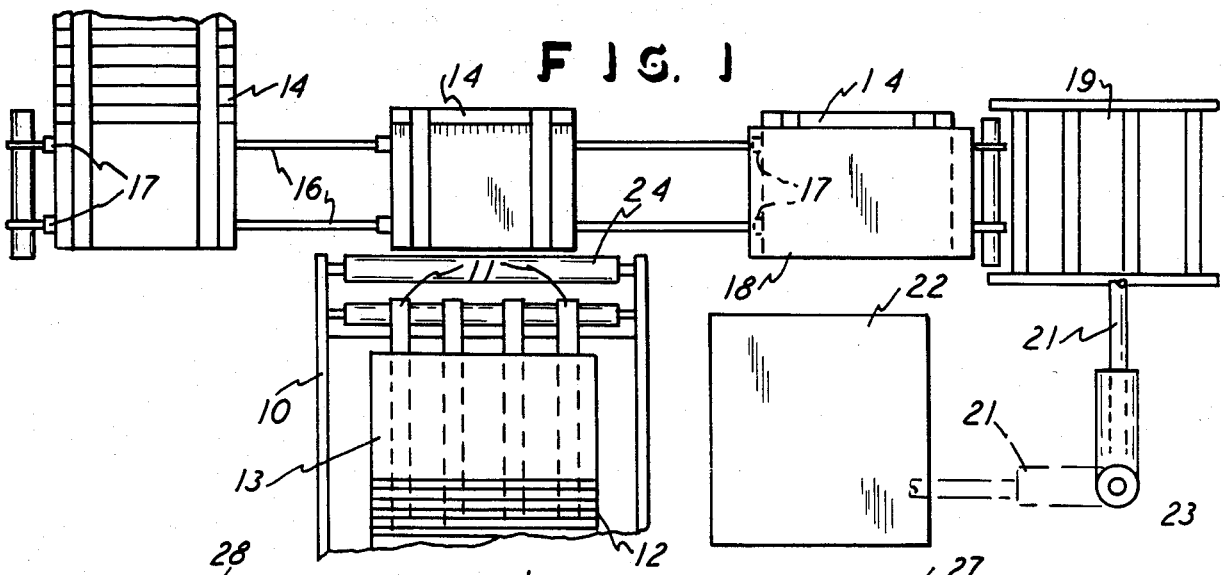
FIG. 1 is a top plan view of a portion of the apparatus of this invention.

This invention is described with reference to the accompanying drawings, and, in that description, the method invention is also inherently described. Thus, FIG. 1 shows a conventional sheet stacker 10 having the usual stacker belts 11 on which an imbricated stream of sheets 12 is supported and would be moving in the upward direction, as viewed in FIG. 1. Thus, a stack of sheets can be formed at the location of the sheet designated 13, and that stack is moved upwardly and onto a tray 14 which is positioned in line with the sheet stream 12, as shown. A supply of trays 14 is made available to a conveyor 16 which engages the bottom one of a stack of the trays 14, as shown in FIG. 1 on the left thereof, and the conveyor 16 has pushers 17 which move one of the trays 14 into line with the sheet stream 12 so that the sheet stack can be placed on that one tray 14. The conveyor 16 is further moved toward the right, as viewed in FIG. 1, and it carries the combined tray 14 and stack 18 to the position shown in FIG. 1, and again the pushers 17 move the assembled tray and stack as mentioned. A collecting area 19 can be provided for a plurality of the trays 14 and stacks 18 thereon, and those trays with stacks can then be engaged by an arm or a robot 21 which moves the stacks onto a pallet 22. That is, the arm 21 can be a telescoping type of arm, as shown, and it can pivot about a support and pivot point 23 to swing to the dot dash line position shown in moving the stacks to the pallet 22.

The structure and operation of the stacker 10 is already known by anyone skilled in the art, and they also understand how the stack is formed at 13. This particular invention provides the special tray 14 and locates that tray in a position for receiving the stack of sheets, such as the stack 18 shown on the tray 14 at the right in FIG. 1. That is, the stack formed at 13 can be moved directly onto the tray 14 in line with the stream 12, and that movement can be accomplished by means of a roller 24 engaging the stack, if desired so that the stack can be moved directly onto the tray 14. No further description or showing of a stacker is necessary, since stackers are now well known and commonly used in the graphic arts industry, and one example thereof is shown in U.S. Pat. No. 3,781,005 which shows the formation of a stack of sheets in a vertical stack, and it is that vertical stack that can be moved directly onto the tray 14 of this invention, as is apparent and has been described.

Figure 3:
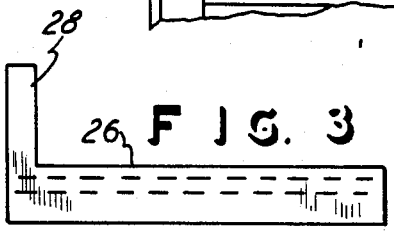
FIGS. 2 and 3 are front and side views, respectively, of the tray of this invention for holding a stack of sheets.
Figure 2:
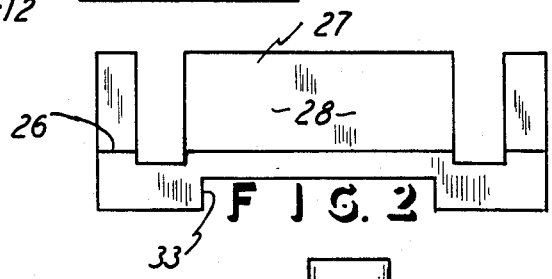

FIG. 1 shows the plan view of the tray 14, and FIGS. 2 and 3 show elevational views thereof, and it will be seen that the tray 14 includes a planar floor 26 and an upright wall 27, all to form a right angle tray, as viewed from the side such as in FIG. 3. Thus the stack of sheets will rest on the floor 26 and will abut the front surface 28 of the back wall 27, at least in the lower portion of the sheet stack 18, as indicated in FIG. 4 where the dot dash lines show a stack 18.

Figure 4:
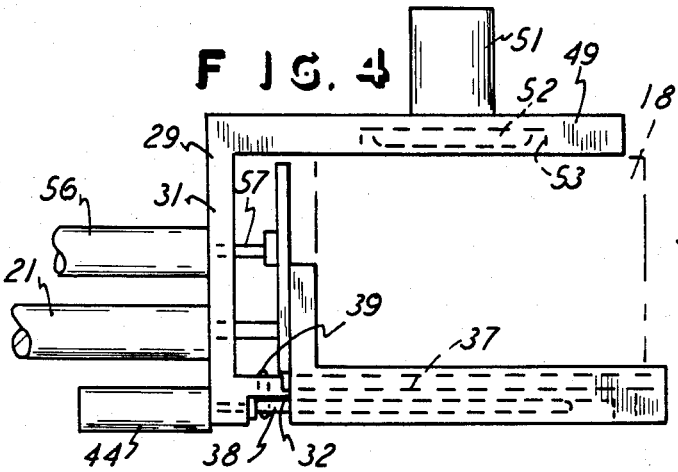
FIGS. 4 and 5 are side and front views, respectively, of said tray with the mechanism for holding the tray and for ejecting the sheets therefrom.
Figure 5:
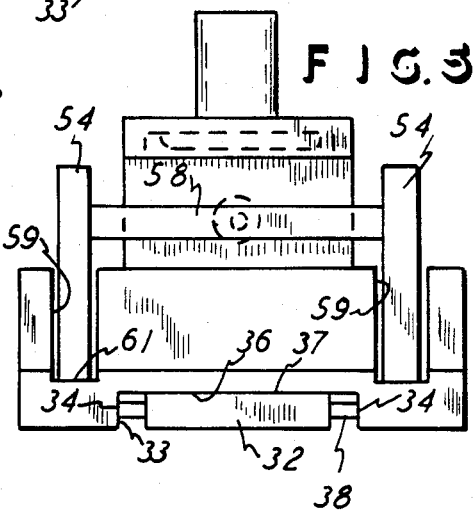

The end of the pick-up arm or robot 21 is also shown in FIG. 4, and the pick-up unit includes the C-shaped member 29 which is fixed with the arm 21 and which therefore remains in the upright position, as shown in FIGS. 4 and 5. The member 29 has a back wall 31, and it has a lower finger 32 which projects into a rectangularly shown opening 33 in the bottom of the tray 14. It will also be noted that the finger 32 is not of a height greater than the height of the opening 33, and number 32 is also of a lesser width than that of the opening 33, all as shown in FIG. 5. Therefore, the tray 14 can be readily picked up and deposited from and to any other surface, such as a tier of the stack of sheets or off the pallet 22 or another station to be described in connection with FIG. 7.

The tray opening 33 has side walls 34 as well as the top wall 36. Of course the top wall 36 is engaged by the top surface 37 of the finger 32 so that the tray 14 and the stack thereon can be lifted by the arm 21. Further, the finger 32 has expandably movable members 38 which are pivoted on the finger 32 about the pins 39, and thus the ends 41 of the fingers 38 swing in and out relative to the finger 32 and therefore the ends 41 can bear against the side walls 34 of the tray 14 to therefore clamp and hold the tray in a firm manner. That is, the robot or arm 21 thus has an engager in the form of the pivotable fingers 38 as well as the finger 32 for contacting the tray 14 and thus firmly hold the tray.

Figure 6:
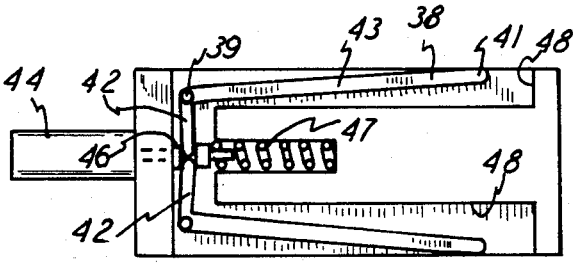
FIG. 6 is a bottom plan view of the mechanism shown in FIG. 4.

FIGS. 4 and 6 show that the fingers 38 are right angle members, having angled lengths 42 integral with the other finger lengths 43 so that they form a right angle member supported on the respective pivots 39. A fluid cylinder 44 is mounted on the pick-up wall 31, and it has a piston 46 which extends into contact with the finger sections 42 to swing the finger ends 41 outwardly into contact with the tray walls 34, as mentioned. Upon release of the fluid pressure in the conventional fluid cylinder 44, a compression spring 47 then acts on the finger lengths 42 to pivot them about the pins 39 and thus move the finger ends 41 inwardly and toward each other to release them from the walls 34 when it is desired that the tray 14 be released by the robot engager being described and shown in the drawings. Of course the spring 47 has one end abutted in the pick-up finger section 32, and it has its other end in engagement with the finger lengths 42, all to create the spring return of the finger ends 41, as described and as will be apparent to anyone skilled in the art with the showing and the description given herein.

For the aforesaid accommodations of the fingers 38, the finger 32 has recesses 48 in the bottom thereof so that the fingers 38 are in the same horizontal plane as the finger 32, as shown in FIGS. 4, 5, and 6.

The engager 29 also has an upper portion 49 which supports a fluid cylinder 51 having a piston 52 disposed in a recess 53 in the upper portion 49, all as shown in FIGS. 4 and 5. The piston 52 can be lowered from the position shown, and it will thus bear downwardly on the top of the stack 18 held by the engager 29, all for securing the stack 18 and its tray 14 under the control of the engager 29. Of course when the stack 18 is to be removed from the engager 29, then the piston 52 is raised and then the stack is released.

FIGS. 4 and 5 also show that the member 29 has ejector pushers 54 which are connected with a fluid cylinder 56 mounted on the engager 29 and having a rod 57 extending into engagement with the two pushers 54 through a cross bar 58 which is suitably connected therewith. The pushers 54 are upright members which move back and forth in openings 59 formed in the tray back wall 28 and also formed as two grooves 61 in the tray floor 26, as best seen in FIG. 5. Thus, extension of the cylinder 56 will move the pushers 54 along the tray 14 and thus eject the stack 18 which is resting on the tray floor 26, and this action occurs in connection with the utility to be described in conjunction with FIG. 7. However, at this time it will be understood that the fingers 43 are securely holding the tray 14 while the pushers 54 eject the stack 18 from the tray.

Figure 7:
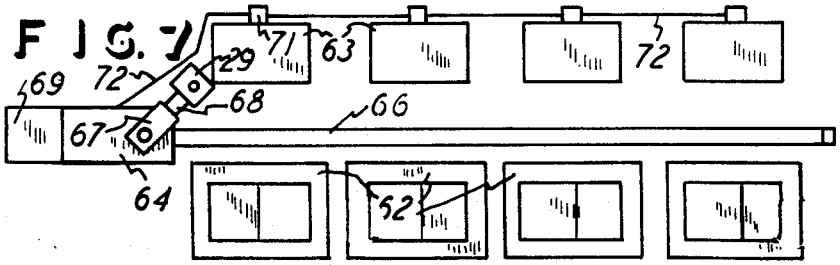
FIG. 7 is a plan schematic view of the sheet feeder of the bindery and the stack station and the robot acting therebetween.

FIG. 7 shows the plurality of stations 62 which receive the plurality of trays and stacks and thus make the sheets available for feeding into a conventional sheet bindery which is shown as the row of conventional bindery feeder mechanisms 63. Those skilled in the art are fully informed as to the nature and purpose of sheet binderies and their feeders, and U.S. Pat. Nos. 3,635,463 and 3,853,234 and 3,982,749 are examples of sheet feeders used in conjunction with binders. That is, the sheet feeders mentioned are those of the type which receive a stack of sheets, such as the stack 18, and which feed the sheets off into collating and binding mechanisms which need not be shown herein except for the showing of the sheet feeders designated 63. A robot mechanism 64 is movable along a track 66 between the rows 62 and 63, and the mechanism 64 has a pivotable arm 67 and a telescoping extension 68, all of any conventional arrangement and operation for extending and contracting the arm 68 which supports the engager 29, as shown in FIG. 7, and it will be understood that the arm 68 is comparable to the support arm 21. Thus, the robot 64 can move into position between the aligned ones of the respective supply rows 62 and feeder rows 63, that is, the movement would be on the track 66, and the arm 68 can be positioned and extended to engage the tray and its stack station 62 and then pivot and position that stack in the feeder 63 by ejecting the stack off its tray 14 while holding the tray 14 and then leaving the stack 18 on the feeder 63 and depositing the empty tray 14 in a tray magazine or container 69 which moves along with the mechanism 64. Again, one skilled in the art can readily understand the arrangement for moving mechanism 64 along the track 66 and for operating the pivot arm 67 and extending and retracting the telescoping arm 68, all for the purposes mentioned providing the robot or automatic mechanism for picking up the stack off the station 62 and depositing it on the feeder mechanism 63 and placing the tray 14 into the magazine 69 at which point engager arms or fingers 43 are released so that the tray can be left in the magazine 69.

Additionally, sensors 71 are suitably operatively related to the feeder 63 and have connections, such as the wire connections 72 extending to the robot mechanism 64 so that the sensors 71 may be electrical and may detect the quantity of sheets in the feeder 63 and thus send a signal through the electric wire 72 to the robot 64 which will then automatically be positioned adjacent the feeder 63 which is in need of additional sheets 12. In that manner, the process for supplying the feeder 63 is fully automated. Any conventional sensor can be used for detecting the quantity of sheets at the fingers 63 and for signaling the robot 64, and one example thereof is seen in FIG. 5 of U.S. Pat. No. 3,853,234 where a detector exists for detecting the movement of a stack of sheets past the detector, and that may be the nature of the sensor 71 so that when one stack of sheets passes the sensor 71 on the feeder 63 an electric signal will be sent to the robot 64 to signal the need for additional sheets on that feeder 63. Additionally, U.S. Pat. Nos. 3,635,463 and 3,982,749 both show sensors or detectors which sense the quantity of sheets in a stack and thereby send an electric signal to a remote part of the apparatus for controlling that apparatus, and that type of sensing and signaling can also be employed in the present invention and will be readily understood by anyone skilled in the art.

The foregoing of course also describes the method, as well as the apparatus, for an automated system for moving sheets between a printing press and a sheet bindery, where the press is producing the sheets 12 which are laid onto the conveyor belt 11. The automated or robot mechanism described engages the tray 14 to hold the tray and to deposit it at desired locations, such as on the pallet 22 and into the feeder 63 after the stacks of sheets have been positioned at the stations 62. That mechanism also has the ejectors in the form of pushers 54 and it has a clamp in the form of the piston 52, all for controlling the stack 18. Thus the mechanism with the arms 21 and 67 are pick-up units which engage trays 14 and can hold the trays as well as release the trays, all as described and as desired. With this apparatus and method invention, there need not be any manual handling of the stacks 18 and there need not be any tying in the form of strapping of the stacks 18, and there need not be any end boards flanking the stacks 18 for the tying process. This also means that the stacks of sheets need not be untied or released for placement into the feeder 63, and the entire system is fully automated and less equipment and material are required. Of course the trays are reusable whereas the straps and end boards are considered disposable and must thus be constantly supplied in the conventional system over which this is an improvement. All of the automation occurs after the stack at 13 is slid onto the tray 14, and that may occur in any suitable manner such as simply sliding the stack onto the tray which is aligned with the stacker 10, as shown in FIG. 1, and the stacker roller 24 may be at a sufficent height above the tray floor 26 to permit the stack to be slid on the roller 24 and directly onto the tray 14. From that point on, the tray 14 and its stack 18 need not be handled manually.

What is claimed is:

1. An automated system for moving a stack of sheets between a printing press and a sheet bindery, comprising a tray having a floor portion extending throughout the base of said stack of sheets for receiving and fully upwardly supporting said stack of sheets, a support for receiving said tray with the stack of sheets, a sheet feeder for the bindery, a movable robot of the automatic operating type, said robot having an engager for engaging said tray and removing said tray from said support and onto said sheet feeder, and a movable ejector included on said robot for removing said stack of sheets from said tray while said engager is engaged with said tray.

2. The automated system as claimed in claim 1, wherein said engager includes a clamp for releasably holding said tray.

3. The automated system as claimed in claim 1 or 2, wherein said tray has an opening therein for receiving said engager.

4. The automated system as claimed in claim 1 or 2, wherein the sheets in the stack are loose and said robot includes a movable clamp for clamping the sheets while they are on said tray.

5. The automated system as claimed in claim 1 or 2, wherein said tray has a floor on which the sheets are supported, said tray having a slot in said floor, and said ejector including a member slidable along said slot for sliding the sheets off said floor.

6. The automated system as claimed in claim 1 or 2, wherein said robot includes a pivotally mounted arm for supporting and positioning said engager.

7. A method of automatically moving sheets between a printing press and a sheet bindery, comprising the steps of stacking sheets in a free-standing and unbound condition onto a tray, picking up and moving said tray with the stack of sheets to a location adjacent a sheet bindery, actuating a pick-up unit and engaging the tray with said pick-up unit and picking up and moving said tray with the stack of sheets to said sheet bindery, restraining movement of said tray at said sheet bindery, and pushing the stack of sheets off said tray and onto said sheet bindery while said tray is restrained, the picking up and moving of said tray with said stack of sheets including the step of clamping said tray and said stack of sheets together with said pick-up unit.

8. The method as claimed in claim 7, including the steps of positioning a plurality of trays with stacks of sheets thereon adjacent a row of sheet binderies, and with each stack of sheets being respective to each of the binderies, for the moving of said trays with the stacks of sheets thereon to respective ones of the binderies.

9. The method as claimed in claim 7 or 8, including the step of sensing the quantity of sheets adjacent each sheet bindery, and actuating said pick-up unit in response to the quantity sensing of the sheets.

10. The method as claimed in claim 7 or 8, including the step of placing onto a pallet a plurality of the trays with stacks of sheets thereon, moving the pallet and the plurality of the trays with stacks of sheets thereon to the location adjacent the sheet bindery, and removing the trays from the sheet bindery after the sheets are pushed off the trays.

* * * * *